US005612543A

United States Patent [19]

Wenner et al.

[11] Patent Number: 5,612,543

[45] Date of Patent: Mar. 18, 1997

[54] SEALED BASKET FOR BOILING WATER REACTOR FUEL ASSEMBLIES

[75] Inventors: Thomas J. Wenner, Hayward; David T. W. Pi, San Jose, both of Calif.

[73] Assignee: Sierra Nuclear Corporation, Scotts Valley, Calif.

[21] Appl. No.: 588,528

[22] Filed: Jan. 18, 1996

[51] Int. Cl.[6] ..... G21F 5/00

[52] U.S. Cl. ..... 250/507.1; 250/506.1; 376/272

[58] Field of Search ..... 250/507.1, 506.1, 250/518.1, 515.1, 505.1; 376/272; 252/633

[56] References Cited

U.S. PATENT DOCUMENTS

| | | | |
|---|---|---|---|
| 4,278,892 | 7/1981 | Baatz et al. | 250/506.1 |
| 4,528,454 | 7/1985 | Baatz et al. | 250/506.1 |
| 4,800,283 | 1/1989 | Efferding | 250/507.1 |
| 4,827,139 | 5/1989 | Wells et al. | 250/507.1 |
| 4,896,046 | 1/1990 | Efferding | 250/507.1 |
| 4,908,515 | 3/1990 | McLeod | 250/507.1 |
| 5,198,182 | 3/1993 | Herrick et al. | 250/518.1 |

*Primary Examiner*—Jack I. Berman
*Assistant Examiner*—Kiet T. Nguyen
*Attorney, Agent, or Firm*—Jeffrey A. Hall

[57] ABSTRACT

A basket for transporting, storing, and containing nuclear fuel assemblies having an assembly of sleeves with a plurality of sleeves arranged in a uniform pattern and secured within a cylindrical shell. Each of the plurality of independent sleeves being sized to secure and contain a fuel assembly. A plurality of alternating sleeves of the plurality of independent sleeves are configured to include an angular shaped separator element secured to each corner of each of the plurality of alternating sleeves. A sheet of neutron absorbing material is positioned between each of the plurality of alternating sleeves for maintaining fission reactions within the basket below a critical level necessary to sustain a fission reaction. A support element for positioning and securing the plurality of independent sleeves is secured within the cylindrical shell. A bottom plate is secured to the bottom of the cylindrical shell providing vertical support for the plurality of independent sleeves. A shield lid is secured to the cylindrical shell and includes a plurality of disc elements and an access port for selective entry into the basket and a lid element is secured to the shield lid and to the cylindrical shell. The lid element including an access port for selective entry into the basket.

10 Claims, 3 Drawing Sheets

SEALED BASKET FOR BOILING WATER REACTOR FUEL ASSEMBLIES

BACKGROUND OF THE INVENTION

1. Field of Invention

This invention relates to shipping baskets and casks for storing and transporting spent nuclear waste materials, and particularly to multi-purpose baskets and casks for transporting, storing, and disposal of boiling water reactor (BWR) plants waste spent fuel and other waste materials.

2. Description of the Related Art

Various baskets and casks have been proposed and implemented for transporting, storing, and disposal of nuclear waste material. However, previous baskets and casks have been limited by durability, cost, and failure to meet stringent regulatory criteria. The present invention overcomes all such limitations by providing a multi-purpose basket which is a separate component of and not integral with a cask which is typically used to encompasses a fuel basket.

A nuclear reactor operates by initiating, maintaining and controlling fission chain reactions. These reactions occur within fissionable material such as Uranium 235 placed within the core of the reactor. In commercial type reactors, nuclear fuel is most often configured in the form of fuel assemblies, which are approximately 12–15 feet long and have a square cross section. Nuclear fuel is both loaded into and removed from the nuclear reactor one assembly at a time.

Since the nuclear reactor operates generating fission chain reactions, the nuclear fuel within a fuel assembly gradually becomes depleted and fission product contaminants build up until it reaches the point that it is no longer capable of maintaining the chain reactions necessary for operation of the reactor. When this occurs, the fuel assembly is removed from the reactor and replaced by a new fuel assembly. The depleted or spent fuel assembly, although incapable of maintaining the fission chain reaction in the reactor, is still highly radioactive and generates a significant amount of heat. Typically, a spent fuel assembly is stored in a pool of water called a spent fuel pool for a period of time after it is removed from the reactor, until temperatures and radioactivity levels have decreased enough to make it safe to move to another form of storage, or transport to a facility for reprocessing or disposal of the spent material.

After a spent fuel assembly has cooled sufficiently to permit its transfer, one of several alternative events may occur. The fuel assembly may be packaged and moved to another location on the reactor site for interim storage, or it may be packaged and transported to a remote site, sometimes at a long distance from the reactor site, for reprocessing, storage, or disposal.

One type of nuclear power plant is a plant which allows water in the reactor to boil to produce steam which drives a turbine generator to produce electricity. This type of plant is referred to as a boiling water reactor (BWR) plant. The fuel assemblies used within BWR reactors have particular characteristics such as size and composition that make them unique with respect to fuel assemblies from other types of nuclear reactors.

Although prior baskets and containers have been proposed and developed to store or transport nuclear fuels all suffer significant limitations and disadvantages. For example, U.S. Pat. No. 4,827,139 issued to Wells et al. discloses a cylindrical cask which contains a fuel basket composed of independent tubes. Such basket is integral with the cask, i.e. the basket is not a separate component, it is not separately sealed, and it cannot be removed from the cask after fuel has been loaded into it. The basket of Wells et al., for example, is capable of containing 31 fuel assembles of an unnamed type, while the basket of the present invention may hold 61 boiling water reactor fuel assemblies. Moreover, the present invention comprises a multi-purpose basket which is a separate component not integral with a cask. After fuel assemblies have been loaded into the basket of the present invention, the basket is sealed and may be placed within and removed from various types of casks, such as storage casks, transportation casks, or transfer casks, thereby enabling the basket to be used for many different applications.

While other baskets have been proposed and configured to act as a separate and removable component of casks all differ significantly from the present invention by using a different basket structure than the sleeve type structure disclosed herein and are restricted to accommodating fewer fuel assemblies.

The present invention encompasses a multi-purpose, sealed, fuel basket which secures and contains boiling water reactor type fuel assemblies. The basket of the present invention may be used for various applications including:

1. Storage of contained fuel assemblies inside of a storage cask for storage either at the reactor site of at a remote site.

2. Transporting of contained fuel assemblies from one location to another inside a transportation cask over public or private transportation routes.

3. Transfer means for transferring the contained fuel assemblies inside of a transfer cask between the spent fuel pool, a storage cask, and a transportation cask.

4. Disposal means for the disposal of spent nuclear fuel used in a facility or facilities constructed for the disposal of spent nuclear fuel.

The basket of the present invention provides a means to meet the very stringent set of criteria that has been established by regulatory authorities in order to ensure safety during the transportation and storage of nuclear fuel assemblies. The basket is specifically designed and constructed to ensure that the nuclear chain reaction is maintained below critical limits, and harmful radiation does not escape. The basket configuration assures that these conditions are maintained even under extreme circumstances such as accidents, geologic stress, pressure, and the like.

Accordingly, it is the primary object of this invention to provide a basket for the containment of nuclear waste from nuclear reactors which is extremely durable, resilient, easy to use, store, transport, and contain, and which is adaptable to a wide variety of storage casks, transportation casks, transfer casks, and contained fuel assemblies.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a basket for transporting, storing, and containing nuclear fuel assemblies is provided having an assembly of sleeves with a plurality of sleeves arranged in a uniform pattern and secured within a cylindrical shell. Each of the plurality of independent sleeves being sized to secure and contain a fuel assembly. A plurality of alternating sleeves of the plurality of independent sleeves are configured to include an angular shaped separator element secured to each corner of each of the plurality of alternating sleeves. A sheet of neutron absorbing material is positioned between each of the plurality of alternating sleeves for maintaining fission reactions within the basket below a critical level necessary to sustain a fission reaction. A support element for positioning and securing the plurality of independent sleeves is secured within the cylindrical shell. A bottom plate is secured to the bottom of the cylindrical shell providing vertical support for the plurality of independent sleeves. A shield lid is secured to the cylindrical shell and includes a plurality of disc elements and an access port for selective entry into the basket and a lid element is secured to the shield lid and to the cylindrical shell. The lid element includes an access port for selective entry into the basket.

There is also provided, in accordance with the invention a basket for a cask for transporting, storing, and containing nuclear fuel assemblies, comprising: an assembly of sleeves having a plurality of sleeves arranged in a uniform pattern and secured within a cylindrical shell. Each of the plurality of independent sleeves being sized to secure and contain a fuel assembly; a plurality of alternating sleeves of the plurality of independent sleeves each being configured to include an angular shaped separator element secured to each corner of each of the plurality of alternating sleeves. A neutron absorbing means for absorbing neutrons is positioned between each of the plurality of alternating sleeves for maintaining fission reactions within the basket below a critical level necessary to sustain a fission reaction. Support element means are provided for positioning and securing the plurality of independent sleeves. A bottom plate secured to the cylindrical shell providing vertical support means for the plurality of independent sleeves. Shield means for providing a shield element for the cylindrical shell are provided and secured to the cylindrical shell including a plurality of disc elements and access means for selective entry into the basket. Lid means for providing a lid element are secured to the shield means and to the cylindrical shell. The lid element including access means for selective entry into the basket.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided a basket for transporting, storing, and containing nuclear fuel assemblies having an assembly of sleeves with a plurality of sleeves arranged in a uniform pattern and secured within a cylindrical shell. Each of the plurality of independent sleeves being sized to secure and contain a fuel assembly. A plurality of alternating sleeves of the plurality of independent sleeves are configured to include an angular shaped separator element secured to each corner of each of the plurality of alternating sleeves. A sheet of neutron absorbing material is positioned between each of the plurality of alternating sleeves for maintaining fission reactions within the basket below a critical level necessary to sustain a fission reaction. A support element for positioning and securing the plurality of independent sleeves is secured within the cylindrical shell. A bottom plate is secured to the bottom of the cylindrical shell providing vertical support for the plurality of independent sleeves. A shield lid is secured to the cylindrical shell and includes a plurality of disc elements and an access port for selective entry into the basket and a lid element is secured to the shield lid and to the cylindrical shell. The lid element including an access port for selective entry into the basket.

Figure 1:
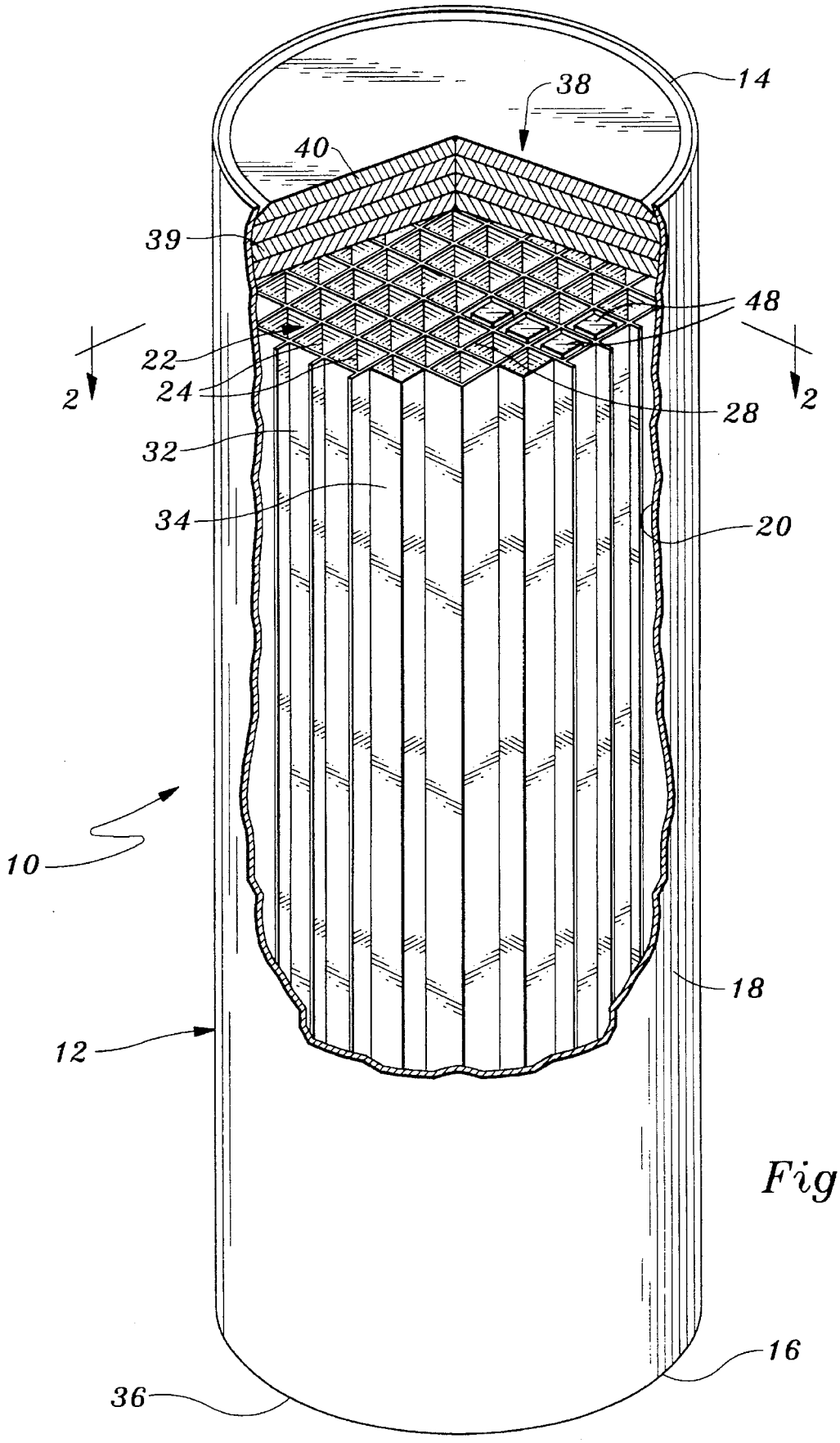
FIG. 1 is an isometric view of a sealed basket for nuclear reactor fuel assemblies, according to the invention.

In FIG. 1, the multi-purpose sealed boiling water reactor fuel basket 10 is shown with shell 12 having a top end 14, a bottom end 16, an outer wall 18 and an inner wall 20, according to a preferred embodiment of the invention. Shell 12 is preferably cylindrically configured but may be provided in other geometric configurations if desired, such as circular, square, rectangular, or the like. Basket 10 is preferably composed of a durable, resilient, non-corrosive material such as steel or steel alloys, and is typically shipped or transported in a transportation, storage, or shipping cask commonly used in the art. As seen in FIG. 1, basket 10 includes an assembly of independent sleeves 22 comprising a plurality of independent sleeves 24. Sleeves are preferably configured having a square cross section and positioned and secured in a uniform pattern inside shell 12 which is preferably cylindrically shaped.

Figure 3:
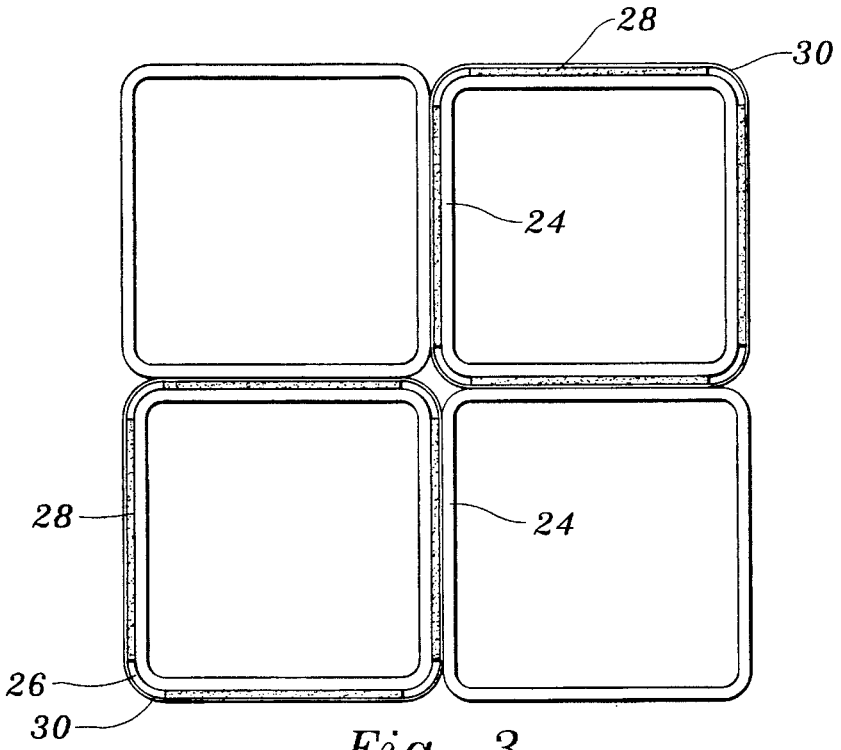
FIG. 3 is a sectional view of a group of four sleeve elements, according to the invention.

Each sleeve 24 is preferably sized and shaped to contain one boiling water reactor fuel assembly 48, however, in alternative embodiments fuel assemblies for different reactor types may be accommodated. Preferably, alternating sleeves 24 are provided within angular-shaped separator 26, best seen in FIG. 3. Separators 26 are preferably secured to each of the four corners of a sleeve by welding separator 26 to each of the four corner of sleeve 24. Separators 26 provide a means to maintain a uniform space between adjacent sleeves. Positioned between separators 26 are sheets of neutron absorbing material 28 which serve to maintain fission reactions within basket 10 below a critical level necessary to sustain a fission chain reaction. The sheets of neutron absorbing material 28 are positioned and secured along the sides of each sleeve 24 by fastening means such as thin strips of steel 30 or other durable, resilient material such as steel alloy located intermittently along the length of the sleeve. The sheets of neutron absorbing material may comprise materials such as boron-carbide, aluminum powder, aluminum alloy, or the like. The steel strips 30 are preferably welded to separators 26 along each edge of the sleeve to hold the sheet of neutron absorbing material 28 in position.

Figure 2:
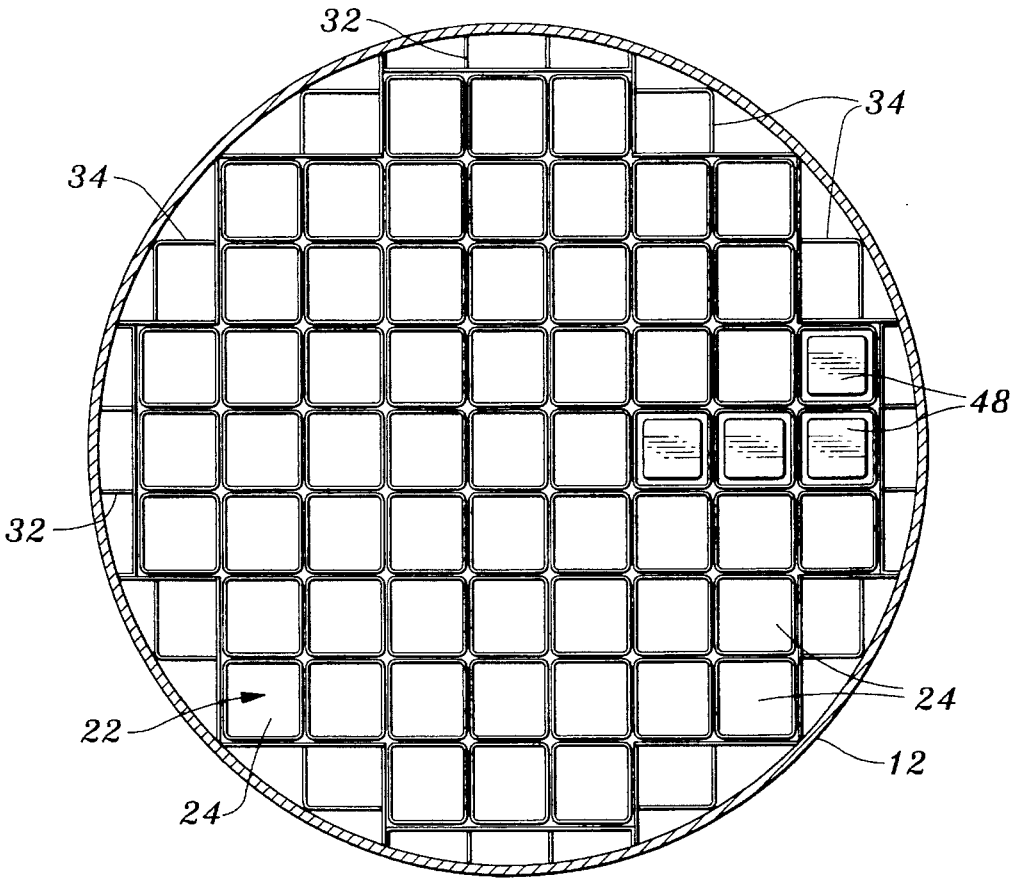
FIG. 2 is a sectional view of such sealed basket, according to the invention.

Referring now to FIG. 2, independent sleeves 24 are preferably positioned and held in place within basket 10 by a support element means preferably comprising a support structure with two separate plates 32 and 34 preferably composed of steel, steel alloy, or other durable resilient material. Plates 32 and 34 are positioned in and fill a gap between the inner wall 20 of cylindrical shell 12 and the perimeter of sleeve assembly 22. As seen in FIG. 2, plates 32 and 34 are preferably installed at multiple locations around the inner perimeter of basket 12. Plates 32 and 34 bear against the sleeves 24 and the inner wall 20 of cylindrical shell 12, however, they are preferably not attached by any fastening means to either.

Figure 4:
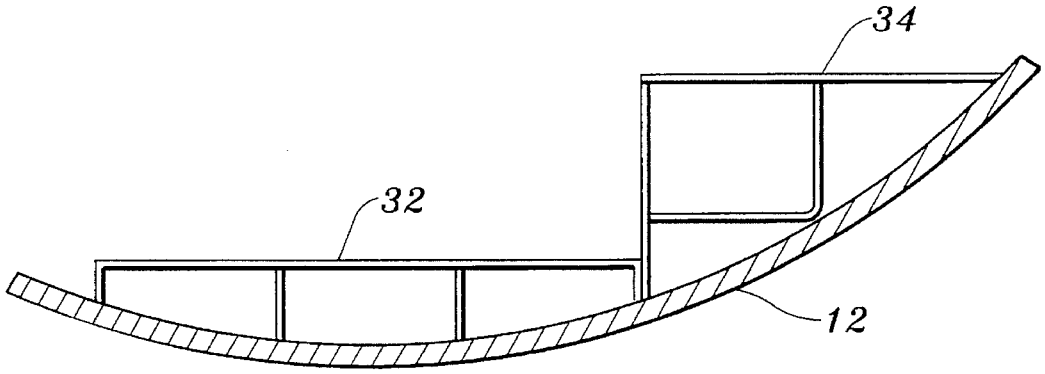
FIG. 4 is a view of the support structures, according to the invention.

In FIG. 1 a bottom plate 36 is shown and is preferably welded to cylindrical shell 12 providing vertical support means for sleeves 24 and support plates 32 and 34 best seen in FIG. 4. Bottom plate 36 is preferably composed of a durable, resilient, non-corrosive material such as steel, steel alloy, or the like, and may be secured to cylindrical shell 12 by welds or other mechanical fastening means.

Figure 5:
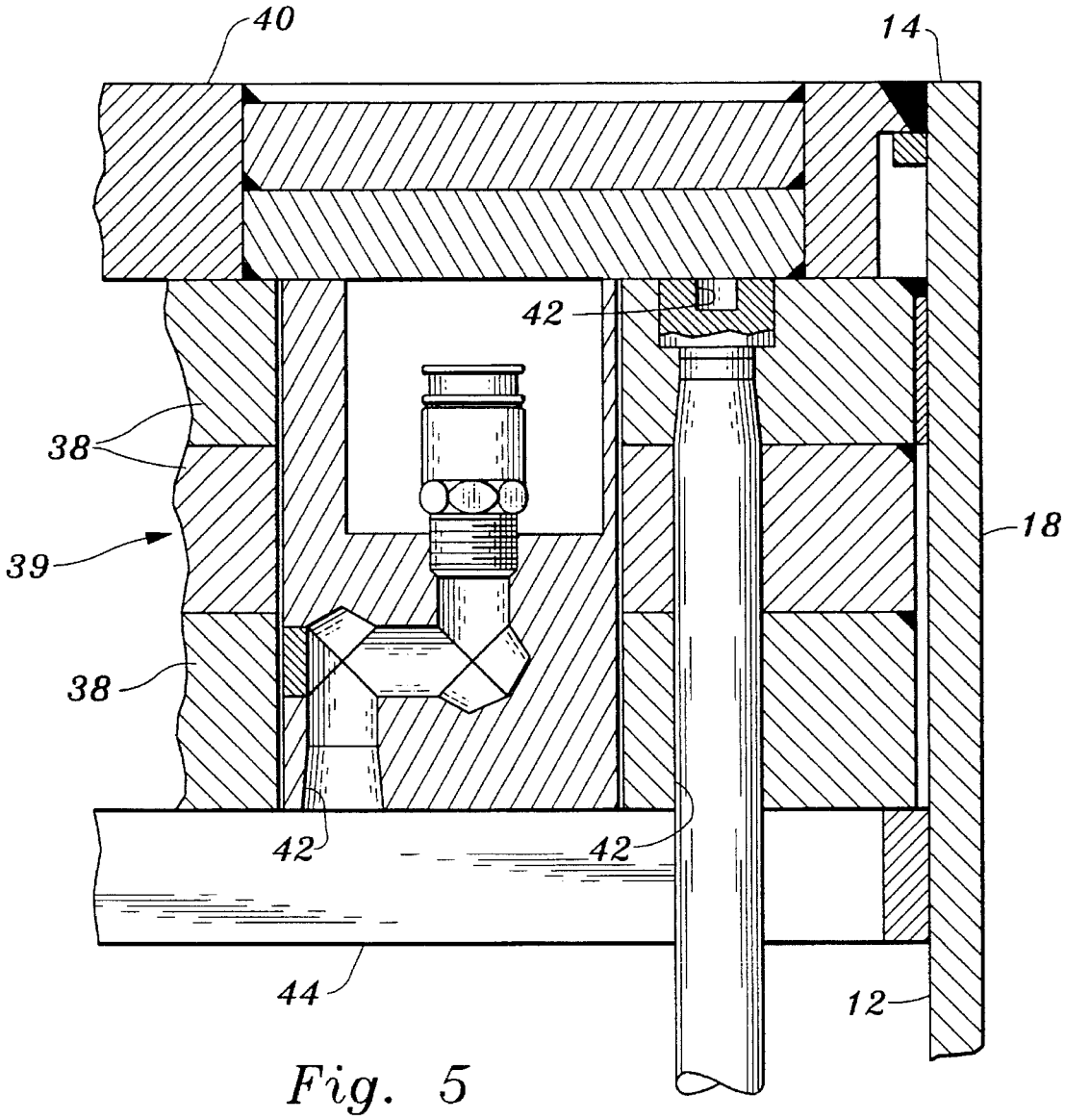
FIG. 5 is a sectional view of the shield lid, lid element, and cylindrical shell intersection, according to the invention.

Referring now to FIGS. 1 and 5, a shield lid 38 and structural lid 40 are shown installed on basket 10. Shield lid 38 provides shielding from radiation emanating from fuel assemblies contained in sleeves 24. Shield lid 38 is preferably composed of a plurality of steel disks 39 welded together and which preferably sandwich a section of the sheet of neutron absorbing material 28. Structural lid 40 is preferably a thick steel disk configured for attachment of hoist rings used to lift basket 10 after it has been loaded. Both shield lid 38 and structural lid 40 are preferably welded to cylindrical shell 12 and have access means, preferably penetrations 42, best seen in FIG. 5, for draining basket 10, vacuum drying basket 10, and backfilling basket 10 with helium after shield lid 38 and structural lid 40 are installed. Penetrations 42 may be apertures or bores and are preferably sealed using multiple welds once the helium backfill process has been completed. Shield lid 38 is preferably supported during its installation by a shield support ring 44.

In operation and use basket 10 is extremely versatile, reliable, and may accommodate a large number of boiling water fuel assemblies, preferably sixty-one, while meeting the stringent requirements established by regulatory authorities both in the United States and abroad to ensure safety during the storage or transportation of fuel assemblies. Basket 10, when contained within a cask, is designed to withstand a wide variety of environmental hazards including earthquakes, floods, tornadoes, and various other accidents such as vertical drops on unyielding surfaces and the like. The basket shell, lid, and supporting structures are such that forces imposed on the contained fuel assemblies 48 during such hazardous conditions or accidents are maintained below those that would cause failure of the basket. Cylindrical shell 12 with welded end plates 36 and lids 38 and 40 provide ample support to sleeves 24 during and shock, accident or other stresses, thereby preventing distortion and maintaining stresses in the sleeves within acceptable limits. Basket 10 may be subjected to temperatures which vary across the basket internals or temperature gradients. The unique configuration of basket 10 and its internal supports provide the basket components with the capability to withstand the effects of various forces imposed on the basket, such as those from a drop event, without constraining the basket such that temperature gradients cause additional stresses in the basket components.

Basket 10 is configured to adequately dissipate heat generated by contained fuel assemblies 48. Basket 10 maintains temperature in the fuel assembly region below the level at which long term degradation of the assemblies could occur. Basket 10 provides a means to maintain fission reactions within the basket at a level which is significantly below the critical level necessary to sustain a fission chain reaction. This is achieved through the use of the sheet of neutron absorbing material 28 operably positioned between adjacent sleeves 24 in basket 10. Basket 10 is specifically designed and constructed to minimize radiation exposure to plant workers and to the general public when the basket is loaded with fuel assemblies and is contained within a transportation, shipping, or storage cask.

As is evident from the above description, basket 10 may be provided composed of a variety materials used to construct various parts of the basket without jeopardizing or limiting the ability of the basket to meet the applicable regulatory criteria. For example, cylindrical shell 12 may be constructed of carbon steel, stainless steel, or other metallic alloys. Sleeves 24 may be composed, for example, of carbon steel, stainless steel, or other metallic alloys.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A basket for transporting, storing, and containing nuclear fuel assemblies, comprising:

an assembly of sleeves comprising a plurality of independent sleeves arranged in a uniform pattern and secured within a cylindrical shell; each of said plurality of independent sleeves being sized to secure and contain a fuel assembly;

a plurality of angular shaped separator elements are selectively positioned and secured between said plurality of independent sleeves;

a sheet of neutron absorbing material being positioned between said plurality of angular shaped separator elements for maintaining fission reactions within said basket below a critical level necessary to sustain a fission reaction;

a support element for positioning and securing said plurality of independent sleeves;

a bottom plate secured to said cylindrical shell providing vertical support means for the plurality of independent sleeves;

a shield lid secured to the cylindrical shell including a plurality of disc elements and access means for selective entry into the basket; and, a lid element secured to said shield lid and to the cylindrical shell; said lid element including access means for selective entry into the basket.

2. The basket of claim 1, wherein each of said plurality of independent sleeves has a square cross-sectional configuration.

3. The basket of claim 1, wherein said fuel assembly is a boiling water reactor fuel assembly.

4. The basket of claim 1, wherein said sheet of neutron absorbing material is secured and positioned along a side of each of said plurality of independent sleeves by steel strips positioned intermittently along said side of each of said plurality of independent sleeves to hold and secure the sheet of neutron absorbing material in a desired position.

5. The basket of claim 1, wherein said support element comprises two separate assemblies of steel plates.

6. A basket for a cask for transporting, storing, and containing nuclear fuel assemblies, comprising:

an assembly of sleeves comprising a plurality of independent sleeves arranged in a uniform pattern and secured within a cylindrical shell; each of said plurality of independent sleeves being sized to secure and contain a fuel assembly;

a plurality of angular shaped separator elements are selectively positioned and secured between said plurality of independent sleeves;

neutron absorbing means for absorbing neutrons being positioned between said plurality of independent sleeves for maintaining fission reactions within said basket below a critical level necessary to sustain a fission reaction;

support element means for positioning and securing said plurality of independent sleeves;

a bottom plate secured to said cylindrical shell providing vertical support means for the plurality of independent sleeves;

shield means for providing a shield element for said cylindrical shell secured to the cylindrical shell including a plurality of disc elements and access means for selective entry into the basket; and, lid means for providing a lid element being secured to said shield means and to the cylindrical shell; said lid element including access means for selective entry into the basket.

7. The basket of claim 6, wherein each of said plurality of independent sleeves has a square cross-sectional configuration.

8. The basket of claim 6, wherein said fuel assembly is a boiling water reactor fuel assembly.

9. The basket of claim 6, wherein said neutron absorbing means is secured and positioned along a side of each of said plurality of independent sleeves by steel strips positioned intermittently along said side of each of said plurality of independent sleeves to hold and secure the neutron absorbing means in a desired position.

10. The basket of claim 6, wherein said support element means comprises two separate assemblies of steel plates.

* * * * *